US007829255B2

(12) United States Patent
Sacripante et al.

(10) Patent No.: US 7,829,255 B2
(45) Date of Patent: Nov. 9, 2010

(54) POLYESTER-WAX BASED EMULSION AGGREGATION TONER COMPOSITIONS

(75) Inventors: Guerino G. Sacripante, Oakville (CA); Richard P. N. Veregin, Mississauga (CA); Edward G. Zwartz, Mississauga (CA); Maria N. V. McDougall, Oakville (CA)

(73) Assignee: Xerox Corporation, Norwalk, CT (US)

( * ) Notice: Subject to any disclaimer, the term of this patent is extended or adjusted under 35 U.S.C. 154(b) by 463 days.

(21) Appl. No.: 11/949,274

(22) Filed: Dec. 3, 2007

(65) Prior Publication Data

US 2009/0142689 A1 Jun. 4, 2009

(51) Int. Cl.
*G03G 9/087* (2006.01)

(52) U.S. Cl. ..... 430/137.14; 430/108.1; 430/109.4

(58) Field of Classification Search ..... 430/137.14, 430/108.1, 109.4
See application file for complete search history.

(56) References Cited

U.S. PATENT DOCUMENTS

| | | | | |
|---|---|---|---|---|
| 5,290,654 | A | 3/1994 | Sacripante et al. | |
| 5,308,734 | A | 5/1994 | Sacripante et al. | |
| 5,370,963 | A | 12/1994 | Patel et al. | |
| 5,593,807 | A | 1/1997 | Sacripante et al. | |
| 6,835,768 | B2 * | 12/2004 | Agur et al. | 524/487 |
| 7,029,817 | B2 | 4/2006 | Robinson et al. | |
| 2003/0232268 | A1 * | 12/2003 | Sacripante et al. | 430/137.14 |
| 2006/0223934 | A1 * | 10/2006 | Chen et al. | 524/500 |

OTHER PUBLICATIONS

Sacripante et al., U.S. Appl. No. 11/676,080, filed Feb. 16, 2007.
Veregin et al., U.S. Appl. No. 11/615,056, filed Dec. 22, 2006.

* cited by examiner

*Primary Examiner*—John L Goodrow
(74) *Attorney, Agent, or Firm*—Oliff & Berridge, PLC

(57) ABSTRACT

Emulsion aggregation toners comprising a polyester-wax resin, wherein the polyester-wax resin includes a wax that is chemically incorporated into the main chain of the polyester.

19 Claims, No Drawings

POLYESTER-WAX BASED EMULSION AGGREGATION TONER COMPOSITIONS

BACKGROUND

Disclosed herein are toner compositions having toner particles comprising a polyester-wax resin, wherein the polyester-wax resin includes a wax that is chemically incorporated into the main chain of the polyester resin.

There is a need for toner particles with improved release properties, such that toner compositions having the toner particles can be used in oil-less fusing fixtures or with fusers requiring very little oil as a release agent. In known methods for making toner particles, wax is typically separately incorporated into the toner formulation during the emulsion aggregation process for use in these types of fixtures/fusers. However, in some development systems, the free wax particles that may be generated on a toner particle's surface may adversely affect wires in the xerographic device.

Specifically, in some development systems, where toner is developed from a donor roll to the imaging member, it is necessary to apply a high voltage DC and a high AC voltage, which can be as high as about 1000 V each, to a fine wire of about 150 microns or less, which is stretched across the length of the donor roll, to detach the toner from the donor roll to enable the toner to be developed to the imaging member. This wire must be kept clean of contamination, which is any material which becomes stuck on the wire and thus builds up on the wire surface. This contamination will result in poor image quality, such as streaks in the process direction, as areas of the wire that are contaminated provide poor development, which is evident as streaks of lower toner image density on the imaging member and on the final image on the paper. Also, once a substantial portion of the wire becomes severely contaminated, the overall development of toner also is reduced. This results eventually in images that are too light in image density. It is known that free wax, that is, wax that is not incorporated within the toner, can be attracted to the wire out of the developer, and accumulate on the wire where it builds up with time. The result is streaks on the prints and reduced development as the machine continues to print. This problem will not go away without removing and replacing the wires, which is not a desirable solution. Thus, it is still desired to produce toner particles suitable for use with oil-less fusing fixtures, without adversely affecting any component of a xerographic device.

The toner compositions having toner particles comprising a polyester-wax resin as described herein are capable of use in an oil-less fusing fixture, without adversely affecting the xerographic device.

SUMMARY

In embodiments, described herein is an emulsion aggregation toner composition having toner particles comprising a binder and an optional colorant, wherein the binder is a polyester-wax resin comprising a wax chemically incorporated into a main chain of a polyester resin.

In further embodiments, described herein is an electrophotographic image forming apparatus comprising a photoreceptor, a development system, and a housing in association with the development system for a developer having an emulsion aggregation toner comprising a binder and an optional colorant, wherein the binder is a polyester-wax resin comprising a wax chemically incorporated into a main chain of a polyester resin.

In yet further embodiments, described herein is a method for making toner particles comprising forming a polyester-wax resin emulsion containing a polyester-wax resin, forming the polyester-wax resin emulsion and optional colorant into a pre-toner mixture, and aggregating and coalescing the pre-toner mixture to form the toner particles.

EMBODIMENTS

Described herein are toner compositions having toner particles comprising a polyester-wax resin, wherein the polyester-wax resin includes a wax that is chemically incorporated into the main chain of the polyester resin. The toner particles may further include a colorant or a photoinitiator.

The polyester-wax resin disclosed herein, which includes a wax chemically incorporated into the main chain of a polyester, allows for a toner to be made without the use of an external or second wax emulsion, while allowing for the use of oil-less fusing or low oil fusing. By omitting the external or second wax emulsion, the cost and time necessary for forming the emulsion aggregation toner particles is decreased.

The polyester-wax resin includes a wax that is chemically incorporated into the main chain of a polyester. In other words, the wax is covalently bonded to the polyester to form a polyester-wax resin. In general, the wax component is found in the main chain, that is, the backbone, of the polyester-wax resin.

If the polyester-wax resin disclosed herein is utilized in making toner particles by an emulsion aggregation process, then acidic end groups are necessary. The polyester-wax resin may have more than one wax portion within the main chain of the polyester-wax resin.

The wax portion of the polyester-wax resin may be in between two polyester portions or in between one polyester portion and between one acidic end group. If the wax portion is a wax having two acidic end groups, two hydroxyl end groups, or one acidic end group and one hydroxyl end group, the wax portion of the polyester-wax resin will be attached to and in between two polyester portions. In other words, the wax portion may typically be randomly incorporated into the main chain of the polyester-wax resin. However, if the wax portion is a wax having one acidic end group or one hydroxyl end group, then the wax portion will likely be attached to and in between one polyester portion and one acidic end group. It is possible for the wax portion to be a wax having more than two acidic end groups or hydroxyl end groups, where it is desired to have some crosslinking in the polyester-wax resin.

The polyester-wax resin may have an acid value ranging from about 5 to greater than about 40, depending on degree of polymerization and overall stoichiometry of the diol to diacid monomers ratio. If the polyester-wax resin has an excess diacid monomer ratio, the resin will have high acid values, however if the diol monomer is used in excess, then the acid value will be low, such as about 5. The functionality of the wax (whether it includes an acidic group or a hydroxyl group) will only be part of the overall monomers used in making the resin.

As described herein, the polyester-wax resin is obtained through the condensation of a diol, a diacid and wax component comprised of one or two functional groups being either or both a carboxylic acid group or hydroxyl group. The wax component is chemically bound through esterification to the polyester resin on the main chain of the polymer, including the end unit of the polymer. As explained above, any wax is suitable for use in deriving the polyester-wax resin described herein so long as it has one or two functional groups, that is, the wax may have one hydroxyl functional end group, one acidic functional end group, two hydroxyl functional end groups, two acidic functional end groups, or one hydroxyl functional end group and one acidic functional end group.

The wax portion of the polyester-wax resin may be a polypropylene, polyethylene or polypropylene-ethylene commercially available from Allied Chemical and Petrolite Corporation, wax emulsions available from Michaelman Inc. and the Daniels Products Company, EPOLENE N-15™ commercially available from Eastman Chemical Products, Inc., VISCOL 550-P™, a low weight average molecular weight polypropylene available from Sanyo Kasei K.K., and similar materials. The commercially available polyethylenes selected usually possess a molecular weight of from about 1,000 to about 1,500, while the commercially available polypropylenes utilized for the toner compositions of the present invention are believed to have a molecular weight of from about 4,000 to about 5,000. Examples of functionalized waxes include amines, amides, imides, esters, quaternary amines, carboxylic acids or acrylic polymer emulsion, for example JONCRYL™ 74, 89, 130, 537, and 538, all available from SC Johnson Wax, chlorinated polypropylenes and polyethylenes commercially available from Allied Chemical and Petrolite Corporation and SC Johnson Wax. Polypropylene alcohols, such as UNILIN 350, UNILIN 550, UNILIN 700 and the like, available from Petrolite, are also suitable for use as the wax portion of the polyester-wax resin.

The polyester portion of the polyester-wax resin may be synthesized to have high acid numbers, for example high carboxylic acid numbers, such as up to 40 mg/eq. KOH. For example, if the polyester-wax resin described herein is to be utilized in forming toner particles by an emulsion aggregation process, then the polyester portion and resulting polyester-wax resin desirably may have a high acid number, in one embodiment, for example, from about 5 mg/eq. KOH to about 40 mg/eq. KOH, in another embodiment from about 10 mg/eq. KOH to about 30 mg/eq. KOH and in yet another embodiment from about 13 mg/eq. KOH to about 22 mg/eq. KOH.

The polyester resin may be made to have a high acid number by using an excess amount of diacid monomer over the diol monomer, or by using acid anhydrides to convert the hydroxl ends to acidic ends, for example by reaction of the polyester with known organic anhydrides such as trimellitic anhydride, phthalic anhydride, dodecyl succinic anhydride, maleic anhydride, 1,2,4,5-benzenedianhydride, 5-(2,5-dioxotetrahydrol)-3-methyl-3-cyclohexene-1,2-dicarboxylic anhydride, 5-(2,5-dioxotetrahydrol)-4-methyl-3-cyclohexene-1,2-dicarboxylic anhydride, pyromellitic dianhydride, benzophenone dianhydride, biphenyl dianhydride, bicyclo[2,2,2]-oct-7-ene tetracarboxylic acid dianhydride, cis,cis,cis,cis,1,2,3,4-cyclopentane tetracarboxylic acid dianhydride, ethylenediamine tetracetic acid dianhydride, 4,4'-oxydiphthalic anhydride, 3,3',4,4'-diphenylsulfone tetracarboxylic dianhydride, ethylene glycol bis-(anhydro-trimellitate), propylene glycol bis-(anhydro-trimellitate), diethylene glycol bis-(anhydro-trimellitate), dipropylene glycol bis-(anhydro-trimellitate), triethylene glycol bis-(anhydro-trimellitate), tripropylene glycol bis-(anhydro-trimellitate), tetraethylene glycol bis-(anhydro-trimellitate), glycerol bis-(anhydro-trimellitate), and mixtures thereof.

An hydroxyl terminated polyester portion may be converted to a high acid number polyester by reacting the hydroxyl terminated polyester with multivalent polyacids, such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid; acid anhydrides of multivalent polyacids; and lower alkyl esters of multivalent polyacids; multivalent polyols, such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like.

In embodiments, the polyester portion may be, for example, poly(1,2-propylene-diethylene)terephthalte, polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-sebacate, polypropylene-sebacate, polybutylene-sebacate, polyethylene-adipate, polypropylene-adipate, polybutylene-adipate, polypentylene-adipate, polyhexalene-adipate polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate, polyethylene-pimelate, polypropylene-pimelate, polybutylene-pimelate, polypentylene-pimelate, polyhexalene-pimelate, polyheptadene-pimelate, poly(propoxylated bisphenol co-fumarate), poly (ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly (ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), poly(1,2-propylene itaconate), or mixtures thereof.

In embodiments, if the polyester-wax resin is to be utilized in a UV curable toner, then the polyester portion of the polyester-wax resin is an unsaturated polyester. Illustrative examples of unsaturated polyesters selected for the process and particles of the present disclosure include any of various polyesters, such as SPAR™ (Dixie Chemicals), BECKOSOL™ (Reichhold Inc), ARAKOTE™ (Ciba-Geigy Corporation), HETRON™ (Ashland Chemical), PARAPLEX™ (Rohm & Hass), POLYLITE™ (Reichhold Inc), PLASTHALL™ (Rohm & Hass), CYGAL™ (American Cyanamide), ARMCO™ (Armco Composites), ARPOL™ (Ashland Chemical), CELANEX™ (Celanese Eng), RYNITE™ (DuPont), STYPOL™ (Freeman Chemical Corporation), XP777 (Reichhold Inc.), mixtures thereof and the like. The resins can also be functionalized, such as carboxylated, sulfonated, or the like, and particularly such as sodio sulfonated, if desired.

In embodiments, the polyester portion is an amorphous polyester. Examples of amorphous resins suitable for use herein include polyester resins, branched polyester resins and linear polyester resins.

The branched amorphous polyester resins are generally prepared by the polycondensation of an organic diol, a diacid or diester, and a multivalent polyacid or polyol as the branching agent and a polycondensation catalyst.

Examples of diacid or diesters selected for the preparation of amorphous polyesters include dicarboxylic acids or diesters selected from the group consisting of terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and mixtures thereof. The organic diacid or diester are selected, for example, from about 45 to about 52 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hyroxyethyl)-bisphenol A, bis(2-hyroxypropyl)-bisphenol A, 1,4-cyclohexanedimethanol, 1,3-cyclohexanedimethanol, xylenedimethanol, cyclohexanediol, diethylene glycol, bis (2-hydroxyethyl)oxide, dipropylene glycol, dibutylene, and mixtures thereof. The amount of organic diol selected can vary, and more specifically, is, for example, from about 45 to about 52 mole percent of the resin. However, excess acid may be necessary, as described above, if the polyester-wax resin is to be utilized in forming toner particles by an emulsion aggregation process, and thus less diol may be used in some embodiments.

Branching agents to generate a branched amorphous polyester resin include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected is, for example, from about 0.1 to about 5 mole percent of the resin.

The amorphous resin may possess, for example, a number average molecular weight (Mn), as measured by gel permeation chromatography (GPC), of from about 10,000 to about 500,000, and for example from about 5,000 to about 250,000; a weight average molecular weight (Mw) of, for example, from about 20,000 to about 600,000, and for example from about 7,000 to about 300,000, as determined by GPC using polystyrene standards; and wherein the molecular weight distribution (Mw/Mn) is, for example, from about 1.5 to about 6, and more specifically, from about 2 to about 4.

As explained above, a polyester resin is generally formulated by mixing a diacid monomer with a diol monomer. To formulate the polyester-wax resin, the wax is added to the diacid monomer and diol monomer. The wax will behave as a diacid or diol monomer or a hydroxyl-acid monomer, and will esterify with the diol and diacid monomers utilized. Thus, instead of forming a polyester resin, a polyester-wax resin is formed. The wax is present in the diacid monomer, diol monomer and wax monomer mixture in amounts of from about 1 weight percent to about 20 weight percent of the total mixture, such as from about 3 weight percent to about 18 weight percent or from about 5 weight percent to about 15 weight percent of the total mixture.

The polyester-wax resin may also be commercially obtained, for example, ET-UP300w from SK Chemicals.

The onset Tg (glass transition temperature) of the polyester-wax resin, and the resulting toner, may be from about 53° C. to about 70° C., such as from about 53° C. to about 67° C. or from about 56° C. to about 60° C. The Ts (softening temperature) of the poly ester-wax resin, and the resulting toner, that is, the temperature at which the polyester-wax resin, and the resulting toner softens, may be from about 90° C. to about 135° C., such as from about 95° C. to about 130° C. or from about 105° C. to about 125° C.

The toner particles derived from the polyester-wax resin described herein may also include a crystalline polyester resin as a separate component of the toner particles, that is, the crystalline polyester resin is not part of the polyester-wax resin described herein. If a crystalline polyester resin is present, then it is generally found in a core portion of the toner particles. However, the polyester-wax resin described herein may be found in both a core portion and a shell portion of the toner particles.

Examples of crystalline polyester resins suitable for use herein include, for example, alkali sulfonated polyester resins. Crystalline resin examples include, but are not limited to, alkali copoly(5-sulfoisophthaloyl)-copoly(ethylene-adipate), alkali copoly(5-sulfoisophthaloyl)-copoly(propylene-adipate), alkali copoly(5-sulfoisophthaloyl)-copoly(butylene-adipate), alkali copoly(5-sulfo-isophthaloyl)-copoly (pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly(ethylene-adipate), alkali copoly (5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly (ethylene-succinate), alkali copoly(5-sulfo-isophthaloyl)-copoly(propylene-succinate), alkali copoly(5-sulfo-isophthaloyl)-copoly(butylenes-succinate), alkali copoly(5-sulfo-isophthaloyl)-copoly(pentylene-succinate), alkali copoly(5-sulfo-isophthaloyl)-copoly(hexylene-succinate), alkali copoly(5-sulfo-isophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly (pentylene-adipate), alkali copoly(5-sulfo-isophthaloyl)-copoly(hexylene-adipate), poly(octylene-adipate), and combination thereof, and wherein the alkali is a metal such as sodium, lithium or potassium.

As used herein, "crystalline" refers to a polymer with a three dimensional order. "Semicrystalline" as used herein refers to materials with a crystalline percentage of, for example, from about 10 to about 60 percent, and more specifically from about 12 to about 50 percent. Further, as used hereinafter "crystalline" encompasses both crystalline resins and semicrystalline materials, including saturated and unsaturated crystalline materials, unless otherwise specified.

If semicrystalline polyester resins are employed herein, the semicrystalline resin may be, for example, poly(3-methyl-1-butene), poly(hexamethylene carbonate), poly(ethylene-p-carboxy phenoxy-butyrate), poly(ethylene-vinyl acetate), poly(docosyl acrylate), poly(dodecyl acrylate), poly(octadecyl acrylate), poly(octadecyl methacrylate), poly(behenylpolyethoxyethyl methacrylate), poly(ethylene adipate), poly(decamethylene adipate), poly(decamethylene azelaate), poly(hexamethylene oxalate), poly(decamethylene oxalate), poly(ethylene oxide), poly(propylene oxide), poly(butadiene oxide), poly(decamethylene oxide), poly(decamethylene sulfide), poly(decamethylene disulfide), poly(ethylene sebacate), poly(decamethylene sebacate), poly(ethylene suberate), poly(decamethylene succinate), poly(eicosamethylene malonate), poly(ethylene-p-carboxy phenoxy-undecanoate), poly(ethylene dithionesophthalate), poly(methyl ethylene terephthalate), poly(ethylene-p-carboxy phenoxy-valerate), poly(hexamethylene-4,4'-oxydibenzoate), poly(10-hydroxy capric acid), poly(isophthalaldehyde), poly(octamethylene dodecanedioate), poly(dimethyl siloxane), poly(dipropyl siloxane), poly(tetramethylene phenylene diacetate), poly (tetramethylene trithiodicarboxylate), poly(trimethylene dodecane dioate), poly(m-xylene), poly(p-xylylene pimelamide), and combinations thereof. The semicrystalline resins possess, for example, a suitable weight average molecular weight Mw, such as from about 7,000 to about 200,000, and more specifically from about 10,000 to about 150,000, a number average molecular weight Mn of, for example, from about 1,000 to about 60,000, and more specifically, from about 3,000 to about 50,000.

The crystalline resin can possess various melting points of, for example, from about 30° C. to about 120° C., such as from about 50° C. to about 90° C., and, for example, a number average molecular weight (Mn), as measured by gel permeation chromatography (GPC) of, for example, from about 1,000 to about 50,000, such as from about 2,000 to about 25,000; with a weight average molecular weight (Mw) of the resin of, for example, from about 2,000 to about 100,000, such as from about 3,000 to about 80,000, as determined by GPC using polystyrene standards. The molecular weight distribution (Mw/Mn) of the crystalline resin is, for example, from about 2 to about 6, such as from about 2 to about 4.

The crystalline resins may be prepared by a polycondensation process of reacting an organic diol, and an organic diacid in the presence of a polycondensation catalyst, although making the crystalline polyester resin need not be limited to such a process. Generally, an about stoichiometric equimolar ratio of organic diol and organic diacid is utilized, however, in some instances, wherein the boiling point of the organic diol is from about 180° C. to about 230° C., an excess amount of diol can be utilized and removed during the polycondensation process. The amount of catalyst utilized may vary, and can be selected in an amount, for example, of from about 0.01 to about 1 mole percent of the resin. Additionally, in place of an organic diacid, an organic diester can also be selected, and where an alcohol byproduct is generated. Examples of suitable organic diols and organic diesters are those described above.

The toner particles having the polyester-wax resin as described herein may be made by any suitable method. However, the emulsion aggregation process is desirable due to the ease in controlling particle size and size dispersion.

An example of a method for generating a resin emulsion for the production of toner particles having the polyester-wax resin is disclosed in U.S. Pat. No. 7,029,817, which is incorporated herein in its entirety by reference. Emulsion aggregation toner dispersions may be generated by other processes including, but not limited to, the melt mixing process disclosed in Ser. No. 11/094,413, which is incorporated herein in its entirety by reference, and the phase inversion process.

The polyester toner particles may be created by the emulsion aggregation (EA) process, which are illustrated in a number of patents, such as U.S. Pat. No. 5,593,807, U.S. Pat. No. 5,290,654, U.S. Pat. No. 5,308,734, and U.S. Pat. No. 5,370,963, each of which are incorporated herein by reference in their entirety. The polyester portion of the polyester-wax resin may comprise any of the polyester materials described in the aforementioned references.

In embodiments, toner compositions may be prepared by any of the known emulsion-aggregation processes, such as a process that includes aggregating a mixture of an optional colorant and any other desired or required additives, and the emulsion comprising the polyester-wax resin, and then coalescing the aggregate mixture. The polyester-wax resin emulsion may be prepared by dissolving the resin in a suitable solvent. In embodiments, the resin emulsion is prepared by dissolving a polyester-wax resin in a solvent. Crystalline polyester emulsions may be similarly prepared.

Suitable solvents include alcohols, ketones, esters, ethers, chlorinated solvents, nitrogen containing solvents and mixtures thereof. Specific examples of suitable solvents include acetone, methyl acetate, methyl ethyl ketone, tetrahydrofuran, cyclohexanone, ethyl acetate, N,N dimethylformamide, dioctyl phthalate, toluene, xylene, benzene, dimethylsulfoxide, mixtures thereof, and the like. If desired or necessary, the resin can be dissolved in the solvent at elevated temperature of from about 40° C. to about 80° C., such as from about 50° C. to about 70° C. or from about 60° C. to about 65° C., although the temperature is desirably lower than the glass transition temperature of the wax and resin. In embodiments, the resin is dissolved in the solvent at elevated temperature, but below the boiling point of the solvent, such as from about 2° C. to about 15° C. or from about 5° C. to about 10° C. below the boiling point of the solvent.

The resin is dissolved in the solvent, and is mixed into an emulsion medium, for example water, such as deionized water optionally containing a stabilizer, and optionally a surfactant. Examples of suitable stabilizers include water-soluble alkali metal hydroxides, such as sodium hydroxide, potassium hydroxide, lithium hydroxide, beryllium hydroxide, magnesium hydroxide, calcium hydroxide, or barium hydroxide; ammonium hydroxide; alkali metal carbonates, such as sodium bicarbonate, lithium bicarbonate, potassium bicarbonate, lithium carbonate, potassium carbonate, sodium carbonate, beryllium carbonate, magnesium carbonate, calcium carbonate, barium carbonate or cesium carbonate; or mixtures thereof. In embodiments, a particularly desirable stabilizer is sodium bicarbonate or ammonium hydroxide. When the stabilizer is used in the composition, it is typically present in amounts of from about 0.1 percent to about 5 percent, such as from about 0.5 percent to about 3 percent, by weight of the resin. When such salts are added to the composition as a stabilizer, it is desired in embodiments that incompatible metal salts are not present in the composition. For example, when these salts are used, the composition should be completely or essentially free of zinc and other incompatible metal ions, for example, Ca, Fe, Ba, etc., that form water-insoluble salts. The term "essentially free" refers, for example, to the incompatible metal ions as present at a level of less than about 0.01 percent, such as less than about 0.005 percent or less than about 0.001 percent, by weight of the wax and resin. If desired or necessary, the stabilizer can be added to the mixture at ambient temperature, or it can be heated to the mixture temperature prior to addition.

Optionally, an additional stabilizer such as a surfactant may be added to the aqueous emulsion medium such as to afford additional stabilization to the resin. Suitable surfactants include anionic, cationic and nonionic surfactants. In embodiments, the use of anionic and nonionic surfactants can additionally help stabilize the aggregation process in the presence of the coagulant, which otherwise could lead to aggregation instability.

Anionic surfactants include sodium dodecylsulfate (SDS), sodium dodecyl benzene sulfonate, sodium dodecylnaphthalene sulfate, dialkyl benzenealkyl, sulfates and sulfonates, abitic acid, and the NEOGEN brand of anionic surfactants. An example of a suitable anionic surfactant is NEOGEN R-K available from Daiichi Kogyo Seiyaku Co. Ltd. (Japan), or TAYCAPOWER BN2060 from Tayca Corporation (Japan), which consists primarily of branched sodium dodecyl benzene sulfonate.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecyl benzyl triethyl ammonium chloride, MIRAPOL and ALKAQUAT available from Alkaril Chemical Company, SANISOL (benzalkonium chloride), available from Kao Chemicals, and the like. An example of a suitable cationic surfactant is SANISOL B-50 available from Kao Corporation, which consists primarily of benzyl dimethyl alkonium chloride.

Examples of nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc Inc. as IGEPAL CA-210, IGEPAL CA-520, IGEPAL CA-720, IGEPAL CO-890, IGEPAL CO-720, IGEPAL CO-290, IGEPAL CA-210, ANTAROX 890 and ANTAROX 897. An example of a suitable nonionic surfactant is ANTAROX 897 available from Rhone-Poulenc Inc., which consists primarily of alkyl phenol ethoxylate.

After the stabilizer or stabilizers are added, the resultant mixture can be mixed or homogenized for any desired time.

Next, the mixture is heated to flash off the solvent, and then cooled to room temperature. For example, the solvent flashing can be conducted at any suitable temperature above the boiling point of the solvent in water that will flash off the solvent, such as a temperature of from about 60° C. to about 100° C., such as from about 70° C. to about 90° C. or about 80° C., although the temperature may be adjusted based on, for example, the particular wax, resin, and solvent used.

Following the solvent flash step, the polyester-wax resin emulsion, may have an average particle diameter in the range of from about 100 to about 500 nanometers, such as from about 130 to about 300 nanometers as measured with a Honeywell MICROTRAC® UPA150 particle size analyzer.

In alternative embodiments, the polyester-wax resin emulsion may be prepared by a suitable process, such as, solvent flash or phase inversion emulsification and the like.

A pre-toner mixture is prepared by combining the colorant, and optionally other materials, surfactant, and the polyester-wax resin emulsion. In embodiments, the pH of the pre-toner mixture is adjusted to from about 2.5 to about 4. The pH of the pre-toner mixture may be adjusted by an acid such as, for example, acetic acid, nitric acid or the like. Additionally, in embodiments, the pre-toner mixture optionally may be homogenized. If the pre-toner mixture is homogenized, homogenization may be accomplished by mixing at from about 600 to about 4,000 revolutions per minute. Homogenization may be accomplished by any suitable means, including, for example, an IKA ULTRA TURRAX T50 probe homogenizer.

Following the preparation of the pre-toner mixture, an aggregate mixture is formed by adding an aggregating agent (coagulant) to the pre-toner mixture. The aggregating agent is generally an aqueous solution of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the pre-toner mixture at a temperature that is below the glass transition temperature ($T_g$) of the emulsion resin. In some embodiments, the aggregating agent may be added in an amount of from about 0.05 to about 3.0 pph and from about 1.0 to about 10 pph with respect to the weight of toner. The aggregating agent may be added to the pre-toner mixture over a period of from about 0 to about 60 minutes. Aggregation may be accomplished with or without maintaining homogenization. Aggregation is accomplished at temperatures that are may be greater than about 60° C.

Thus, the process calls for blending the optional crystalline polyester resin and the polyester-wax resin emulsion, together in the presence of a colorant and optionally other additives, heating the blend from room temperature to about 60° C. The temperature may be slowly raised to 65° C. and held there for from about 3 hours to about 9 hours, such as about 6 hours, in order to provide from about 6 micron to about 12 micron particles, such as about 9 micron particles, that the have a shape factor of, for example, about 115 to about 130 as measured on the FPIA SYSMEX analyzer.

Following aggregation, the aggregates may be coalesced. Coalescence may be accomplished by heating the aggregate mixture to a temperature that is about 5° C. to about 20° C. above the $T_g$ of the amorphous resin. Generally, the aggregated mixture is heated to a temperature of about 50° C. to about 80° C. In embodiments, the mixture may also be stirred at from about 200 to about 750 revolutions per minute to coalesce the particles. Coalescence may be accomplished over a period of from about 3 to about 9 hours.

Optionally, during coalescence, the particle size of the toner particles may be controlled and adjusted to a desired size by adjusting the pH of the mixture. Generally, to control the particle size, the pH of the mixture is adjusted to between about 5 to about 7 using a base such as, for example, sodium hydroxide.

After coalescence, the mixture may be cooled to room temperature. After cooling, the mixture of toner particles of some embodiments may be washed with water and then dried. Drying may be accomplished by any suitable method for drying including freeze drying. Freeze drying is typically accomplished at temperatures of about −80° C. for a period of about 72 hours.

Upon aggregation and coalescence, the toner particles of embodiments have an average particle size of from about 1 to about 15 microns, in further embodiments of from about 4 to about 15 microns, and, in particular embodiments, of from about 6 to about 11 microns, such as about 7 microns. The volume geometric size distribution ($GSD_v$) by volume for (D84/D50) of the toner particles of embodiments may be in a range of from about 1.20 to about 1.35, and in particular embodiments of less than about 1.25.

In embodiments, the process may include the use of surfactants, emulsifiers, and other additives such as those discussed above. Likewise, various modifications of the above process will be apparent and are encompassed herein.

The toner particles described herein may further include other components, such as colorants, and various external additives. Colorant includes pigment, dye, mixtures of dyes, mixtures of pigments, mixtures of dyes and pigments, and the like.

When present, the colorant may be added in an effective amount of, for example, from about 1 to about 25 percent by weight of the particle, such as in an amount of from about 2 to about 12 weight percent. Suitable example colorants include, for example, carbon black like REGAL 330® magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN. CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals). Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracel Pink RF (Ciba-Geigy), Paliogen Red 3871K (BASF), Paliogen Red 3340 (BASF), and Lithol Fast Scarlet L4300 (BASF).

In embodiments, the toner particles described herein may be curable upon exposure to UV radiation, for example, where the polyester portion of the polyester-wax resin includes unsaturated moieties as described above. In such embodiments, the toner may further include suitable photoinitiators, such as UV-photoinitiators including, but not limited to, hydroxycyclohexylphenyl ketones; other ketones such as alpha-amino ketone and 4-(2-hydroxyethoxy)phenyl-(2-hydroxy-2-propyl)ketone; benzoins; benzoin alkyl ethers; benzophenones, such as 2,4,6-trimethylbenzophenone and 4-methylbenzophenone; trimethylbenzoylphenylphosphine oxides such as 2,4,6-trimethylbenzoyl-diphenyl-phosphine oxide or phenylbis(2,4,6-trimethylvbenzyoyl) phosphine oxide (BAPO) available as IRGACURE 819 from Ciba; azo compounds; anthraquinones and substituted anthraquinones, such as, for example, alkyl substituted or halo substituted anthraquinones; other substituted or unsubstituted polynuclear quinines; acetophenones, thioxanthones; ketals; acylphosphines; and mixtures thereof. Other examples of photoinitiators include, but not limited to, 2-hydroxy-2-methyl-1-phenyl-propan-1-one and 2-isopropyl-9H-thioxanthen-9-one. In embodiments, the photoinitiator is one of the following compounds or a mixture thereof: a hydroxycyclohexylphenyl ketone, such as, for example, 2-hydrox-4'-hydroxyethoxy-2-methylpropiophenone or 1-hydroxycyclohexylphenyl ketone, such as, for example, IRGACURE® 184 (Ciba-Geigy Corp., Tarrytown, N.Y.), having the structure:

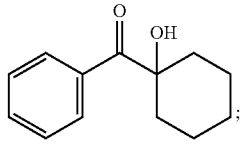

;

a trimethylbenzoylphenylphosphine oxide, such as, for example, ethyl-2,4,6-trimethylbenzoylphenylphosphinate, such as, for example, LUCIRIN® TPO-L (BASF Corp.), having the formula

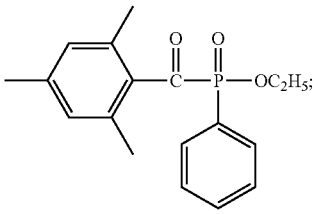

a mixture of 2,4,6-trimethylbenzophenone and 4-methylbenzophenone, such as, for example, SARCURE™ SR1137 (Sartomer); a mixture of 2,4,6-trimethylbenzoyl-diphenylphosphine oxide and 2-hydroxy-2-methyl-1-phenyl-propan-1-one, such as, for example, DAROCUR® 4265 (Ciba Specialty Chemicals); alpha-amino ketone, such as, for example, IRGACURE® 379 (Ciba Specialty Chemicals); 4-(2-hydroxyethoxy)phenyl-(2-hydroxy-2-propyl)ketone, such as, for example. IRGACURE® 2959 (Ciba Specialty Chemicals); 2-isopropyl-9H-thioxanthen-9-one, such as, for example, DAROCUR® ITX (Ciba Specialty Chemicals); and mixtures thereof.

In embodiments, the toner composition contains from about 0.5 to about 15 wt % photoinitiator, such as UV-photoinitiator, such as from about 1 to about 15 wt %, or from about 3 to about 12 wt %, photoinitiator such as UV-photoinitiator. Of course, other amounts can be used as desired.

The toner may also include any suitable surface additives. Examples of surface additives are surface treated fumed silicas, for example TS-530 from Cabosil Corporation, with an 8 nanometer particle size and a surface treatment of hexamethyldisilazane; NAX50 silica, obtained from DeGussa/Nippon Aerosil Corporation, coated with HMDS; DTMS silica, obtained from Cabot Corporation, comprised of a fumed silica silicon dioxide core L90 coated with DTMS; H2050EP, obtained from Wacker Chemie, coated with an amino functionalized organopolysiloxane; metal oxides such as $TiO_2$, for example MT-3103 from Tayca Corp, with a 16 nanometer particle size and a surface treatment of decylsilane; SMT5103, obtained from Tayca Corporation, comprised of a crystalline titanium dioxide core MT500B coated with DTMS (decyltrimethoxysilane); P-25 from Degussa Chemicals with no surface treatment; alternate metal oxides such as aluminum oxide, and as a lubricating agent, for example, stearates or long chain alcohols, such as UNILIN 700™, and the like. In general, silica is applied to the toner surface for toner flow, tribo enhancement, admix control, improved development and transfer stability, and higher toner blocking temperature. $TiO_2$ is applied for improved relative humidity (RH) stability, tribo control and improved development and transfer stability. Examples of suitable $SiO_2$ and $TiO_2$ are those surface treated with compounds including DTMS (decyltrimethoxysilane) or HMDS (hexamethyldisilazane).

The $SiO_2$ and $TiO_2$ may generally possess a primary particle size greater than approximately 30 nanometers, or at least 40 nanometers, with the primary particles size measured by, for instance, transmission electron microscopy (TEM) or calculated (assuming spherical particles) from a measurement of the gas absorption, or BET, surface area. $TiO_2$ is found to be especially helpful in maintaining development and transfer over a broad range of area coverage and job run length. The $SiO_2$ and $TiO_2$ are more specifically applied to the toner surface with the total coverage of the toner ranging from, for example, about 140 to about 200 percent theoretical surface area coverage (SAC), where the theoretical SAC (hereafter referred to as SAC) is calculated assuming all toner particles are spherical and have a diameter equal to the volume median diameter of the toner as measured in the standard Coulter Counter method, and that the additive particles are distributed as primary particles on the toner surface in a hexagonal closed packed structure. Another metric relating to the amount and size of the additives is the sum of the "SAC×Size" (surface area coverage times the primary particle size of the additive in nanometers) for each of the silica and titania particles, or the like, for which all of the additives should, more specifically, have a total SAC×Size range of, for example, about 4,500 to about 7,200. The ratio of the silica to titania particles is generally from about 50 percent silica/50 percent titania to about 85 percent silica/15 percent titania (on a weight percentage basis).

Calcium stearate and zinc stearate can be selected as an additive for the toners of the present invention in embodiments thereof, the calcium and zinc stearate primarily providing lubricating properties. Also, the calcium and zinc stearate can provide developer conductivity and tribo enhancement, both due to its lubricating nature. In addition, calcium and zinc stearate enables higher toner charge and charge stability by increasing the number of contacts between toner and carrier particles. A suitable example is a commercially available calcium and zinc stearate with greater than about 85 percent purity, for example from about 85 to about 100 percent pure, for the 85 percent (less than 12 percent calcium oxide and free fatty acid by weight, and less than 3 percent moisture content by weight) and which has an average particle diameter of about 7 microns and is available from Ferro Corporation (Cleveland, Ohio). Examples are SYNPRO® Calcium Stearate 392A and SYNPRO® Calcium Stearate NF Vegetable or Zinc Stearate-L. Another example is a commercially available calcium stearate with greater than 95 percent purity (less than 0.5 percent calcium oxide and free fatty acid by weight, and less than 4.5 percent moisture content by weight), and which stearate has an average particle diameter of about 2 microns and is available from NOF Corporation (Tokyo, Japan). In embodiments, the toners contain from, for example, about 0.1 to about 5 weight percent titania, about 0.1 to about 8 weight percent silica, or from about 0.1 to about 4 weight percent calcium or zinc stearate.

In embodiments, the desired charge distribution for the toner particles in both the A-zone and the C-zone is from about −2 mm to about −25 mm displacement, such as from about −4 mm to about −20 mm displacement.

The charge performance or distribution of a toner is frequently demarcated as q/d (mm). The toner charge (q/d) is measured as the midpoint of the toner charge distribution. The charge is reported in millimeters of displacement from the zero line in a charge spectrograph using an applied transverse electric filed of 100 volts per cm. The q/d measure in mm can be converted to a value in fC/μm by multiplying the value in mm by 0.092.

In embodiments, it is desired that the ratio of the charge distribution in the A-zone to the C-zone be as close to 1 as possible. This ratio (C-zone/A-zone) is frequently referred to as the relative humidity (RH) sensitivity by those skilled in the art. In embodiments, the RH sensitivity may be in a range of less than about 10, such as from about 0.03 to about 8.

The toner particles described herein also exhibit acceptable toner cohesion. Toner cohesion may be measured using a Hosokawa Micron PT-R tester, available from Micron Powders Systems. Toner cohesion is typically expressed in percent (%) cohesion. Percent cohesion may be measured by placing a known mass of toner, for example 2 grams, on top of a set of stacked screens, for example a top screen that has 53 micron mesh or openings, a middle screen that has 45 micron mesh or openings, and a bottom screen that has 38 micron mesh or openings, and vibrating the screens and toner for a fixed time at a fixed vibration amplitude, for example for 90 seconds at 1 millimeter vibration amplitude. All screens are made of stainless steel. The percent cohesion is then calculated as follows:

$$\% \text{ cohesion}=50\cdot A+30\cdot B+10\cdot C$$

where A is the mass of toner remaining on the 53 micron screen, B is the mass of toner remaining on the 45 micron screen, and C is the mass of toner remaining on the 38 micron screen. The percent cohesion of the toner is related to the amount of toner remaining on each of the screens at the end of the time. A percent cohesion value of 100% corresponds to all the toner remaining on the top screen at the end of the vibration step and a percent cohesion of 0% corresponds to all of the toner passing through all three screens, in other words, no toner remaining on any of the three screens at the end of the vibration step. The greater the percent cohesion for toners, the less the toner particles are able to flow. In embodiments, the toners may have a percent cohesion in the range of, for example, from about 30% to about 80%, such as from about 35% to about 75%, or from about 40% to about 65%.

The toner particles of all embodiments may be included in developer compositions. In embodiments, developer compositions comprise single component developers of toner only, and two component developers of toner particles mixed with carrier particles. In some embodiments, the toner concentration in the developer composition may range from about 1 weight percent to about 25 weight percent, such as from about 2 weight percent to about 15 weight percent, of the total weight of the developer composition.

Examples of carrier particles suitable for mixing with the toner include those particles that are capable of triboelectrically obtaining a charge of opposite polarity to that of the toner particles, such as granular zircon, granular silicon, glass, steel, nickel, ferrites, iron ferrites, silicon dioxide, and the like.

The selected carrier particles can be used with or without a coating, the coating generally being comprised of fluoropolymers, such as polyvinylidene fluoride resins; terpolymers of styrene; methyl methacrylate; silanes, such as triethoxy silane; tetrafluoroethylenes; other known coatings; and the like.

In embodiments, any known type of image development system may be used in an image developing device, including, for example, magnetic brush development, jumping single-component development, hybrid scavengeless development (HSD), etc. These development systems are well known in the art, and further explanation of the operation of these devices to form an image is thus not necessary herein. Once the image is formed with toners/developers described herein via a suitable image development method such as any one of the aforementioned methods, the image is then transferred to an image receiving medium such as paper and the like. In an embodiment described herein, it is desired that the toners be used in developing an image in an image-developing device utilizing a fixing member, such as a fuser roll member. The fixing member suitable for use with the toner having a polyester-wax resin as described herein may be an oil-less fixing member or a low oil fixing member. As used herein and "oil-less fixing member" refers to a fixing member that is utilized with no oil. As used herein a "low oil fixing member" refers to a fixing member, or fuser, that use from about 0.5 μL of oil per print/copy to about 1 μL of oil per print/copy. In contrast, fixing members that are not oil-less and not low oil fixing members are usual used with from about 5 μL of oil per print/copy to about 10 μL of oil per print/copy.

A toner having the polyester-wax resin described herein is particularly suitable for use with an oil-less fixing member or a low oil fixing member because the wax is present in the toner without any preparation disadvantages as described herein. Fuser roll members are contact fusing devices that are well known in the art, in which heat and pressure from the roll are used in order to fuse the toner to the image-receiving medium. Typically, the fuser member may be heated to a temperature just above the fusing temperature of the toner, that is, to temperatures of from about 80° C. to about 150° C. or more.

Embodiments described above will now be further illustrated by way of the following examples.

EXAMPLE I

Preparation of a Polyester-Wax Resin Emulsion

A Polyester-wax resin was derived from about 0.4 mole percent of propoxylated bisphenol A, about 0.5 moles percent of fumaric acid and about 0.1 mole percent of polyethylene wax with hydroxyl end groups available from Petrolite as UNILIN 700, and was prepared as follows.

A 1 liter reactor equipped with a bottom drain valve, double turbine agitator and distillation receiver with a cold water condenser was charged with about 345 grams of propoxylated bisphenol A, about 130.5 of fumaric acid, about 175 grams of UNILIN 700, and about 1.7 grams of butyltin oxide catalyst obtained as FASCAT 4100™ from Elf Atochem North America, Inc. The reactor was heated to about 210° C. with stirring at about 150 revolutions per minute over a duration of about 4 hours, where the pressure of the reactor was maintained at from about 0.1 to about 0.01 mm-Hg. The polymer product was then discharged through the bottom drain onto a container cooled with dry ice to yield the polyester-wax resin. The above resulting resin product was measured to have a glass transition temperature of about 52.9° C. (onset) utilizing the 910 Differential Scanning Calorimeter available from E.I. DuPont operating at a heating rate of 10° C. The acid number of the polyester resin product was found to be about 13.9 mg/eq. KOH.

To about 125 grams of the above polyester-wax resin, about 816.67 grams of ethyl acetate was added. The resin was dissolved by heating in a solvent to about 65° C. on a hot plate and stirring at about 200 rpm. In a separate 4 liter glass reactor vessel were added about 3.05 grams, acid number of approximately 17 mg/eq. KOH, of sodium bicarbonate and about 708.33 grams of deionized water. The resulting aqueous solution was heated to about 65° C. on a hot plate with stirring at about 200 rpm. The dissolved resin in the ethyl acetate mixture was slowly poured into the 4 liter glass reactor containing the aqueous solution with homogenization at about 4,000 rpm. The homogenizer speed was then increased to about 10,000 rpm for about 30 minutes. The resulting homogenized mixture was placed in a heat jacketed Pyrex distillation apparatus and stirred at about 200 rpm. The temperature was increased to about 80° C. at about 1° C./minute. The ethyl acetate was distilled from the mixture at about 80° C. for about 120 minutes. The mixture attained was then cooled to below about 40° C. then screened through a 20 micron screen. The mixture was pH adjusted to about 7 using about a 4 weight percent NaOH aqueous solution and centrifuged. The resulting polyester-wax resin was comprised of about 18.5 weight percent solids by weight in water with a volume average diameter of about 180 nanometers as measured with a Honeywell UPA150 particle size analyzer.

EXAMPLE II

Emulsion Aggregation Toner Having 95.5% Polyester-Wax Resin of Example I, and 4.5% Cyan PB15:3 (The Toner has 28% of the Polyester-Wax Resin as a Shell)

A 2 liter kettle was charged with about 453 g of the polyester-wax emulsion of Example I (18.5% solids with a particle size of about 180 nm). To this was added about 37.5 g of Cyan Pigment Blue 15:3 Dispersion (about 17% solids available from Sun Chemicals), and about 4.1 grams of DOWFAX surfactant (about 47.5% aqueous solution), and the mixture was stirred at about 100 rpm. To this was then added about 65 grams of about 0.3 N nitric acid solution, until a pH of about 3.7 was achieved, followed by homogenizing at about 2,000 rpm. To this was then added aluminum sulfate (about 0.25 ppH), and the homogenizer was increased to about 4200 rpm at the end of the aluminum sulfate addition. The pH of the mixture was about 3.1. The mixture was then stirred at from about 200 rpm to about 300 rpm with an overhead stirrer and placed in a heating mantle. The temperature was increased to about 47.5° C. over about a 30 minute period, during which period the particles grew to about 8.3 microns. A solution comprised of sodium hydroxide in water (about 4% by weight of NaOH) was added to freeze the size (prevent further growth) until the pH of the mixture was about 6.8. During this latter addition, the stirrer speed was reduced to about 150 rpm. The mixture was then heated to about 63° C. over about 60 minutes, after which the pH was maintained at from about 6.6 to about 6.8 with dropwise addition of an aqueous solution of sodium hydroxide (about 4% by weight). The mixture was then heated to coalescence at a final temperature of about 68° C. and about 0.3 M acid was added until a pH of about 6.14 was achieved. The resulting toner particles were of spherical morphology and displayed a size of about 7.5 microns with a GSD of about 1.25.

EXAMPLE III

Emulsion Aggregation Toner Having 86.9% Polyester-Wax Resin, 8.6% Crystalline Resin and 4.5% Cyan PB15:3 (The Toner has 28% of the Polyester-Wax Resin as a Shell)

A 2 liter kettle was charged with about 412 g of the polyester emulsion (about 18.5% solids) with a particle size of about 135 nm. The emulsion was prepared by a phase inversion process and utilizing a polyester-wax resin obtained from SK Chemicals (ET-UP300w) with a glass transition temperature (Tg) of about 55° C. and an acid number of about 14.75. To this was added about 56.5 grams of a crystalline emulsion comprised of poly(ethylene-1,12-dodecanoate), (about 18.5%) with a particle size of about 194 nm, about 37.5 g of Cyan Pigment Blue 15:3 Dispersion (about 17% solids available from Sun Chemicals), and about 4.1 grams of DOWFAX surfactant (about 47.5% aqueous solution), and the mixture stirred at about 100 rpm. To this was then added about 65 grams of about 0.3 N nitric acid solution, until a pH of about 3.7 was achieved, followed by homogenizing at about 2,000 rpm. To this was then added aluminum sulfate (about 0.25 ppH), and the homogenizer was increased to about 4200 rpm at the end of the aluminum sulfate addition. The pH of the mixture was about 3.1. The mixture was then stirred at from about 200 rpm to about 300 rpm with an overhead stirrer and placed in a heating mantle. The temperature was increased to about 47.5° C. over about a 30 minute period, during which the particles grew to about 8.3 microns. A solution comprised of sodium hydroxide in water (about 4% by weight of NaOH) was added to freeze the size (prevent further growth) until the pH of the mixture was about 6.8. During this latter addition, the stirrer speed was reduced to about 150 rpm. The mixture was then heated to about 63° C. over about 60 minutes, after which the pH was maintained at from about 6.6 to about 6.8 with dropwise addition of an aqueous solution of sodium hydroxide (4% by weight). The mixture was then heated to coalescence at a final temperature of about 68° C. and about 0.3 M acid was added until a pH of about 6.14 was achieved. The resulting toner particles were of spherical morphology and displayed a size of about 9.8 microns with a GSD of about 1.28.

Results

Developers for bench charging evaluations were prepared by using about 100 g of about 65 micron PMMA coated carrier and about 4.5 g of toner. Two developers were prepared and conditioned in two chambers with different zone conditions, the A-zone chamber had a temperature and RH setting of about 28° C. and 85% relative humidity (RH), and the C-zone chamber had a temperature and RH setting of about 12° C. and about 15% RH. Evaluating xerographic developers in extreme conditions enables one of ordinary skill in the art to understand the RH sensitivity of the toner.

Developer charging was done in two steps, about a 5 minute and about a 60 minutes paint shaking time, which provides information on developer behavior, such us any increase or decrease in charging from that first initial 5 minutes charging. Desirably, a developer reaches stable charge in a short time period and maintains this level with minimal change with increasing charging time. The tribo blow-off Q/m values in μC/g, the peak of the q/d charge distributions in fC/microns and the distribution index, which is the ratio of the width of the charge distribution to the peak charge, were measured.

Results indicated that emulsion aggregation toner made from polyester-wax and crystalline resins have acceptable charging values in A- and C-zones against the carrier compared to the conventional parent toner control.

TABLE A

| | Tribocharge | | |
|---|---|---|---|
| Toner | A-Zone | C-Zone | RH |
| Example II | −8.2 | −15 | 0.55 |
| Example III | −5.3 | −9.7 | 0.55 |

Fusing Results:

Unfused test images were made using a Xerox Corporation DC12 color copier/printer. Images were removed from the Xerox Corporation DC12 before the document passed through the fuser. These unfused test samples were then fused using a Xerox Docucolor 3535 fuser having an oil-less fuser. The fuser roll temperature was varied during the experiments so that gloss and crease area could be determined as a function of the fuser roll temperature. Print gloss was measured using a BYK Gardner 75 degree gloss meter. How well toner adheres to the paper was determined by its crease fix minimum fusing temperature (MFT). The fused image was folded and an 860 gram weight of toner was rolled across the fold after which the page was unfolded and wiped to remove the fractured toner from the sheet. This sheet was then scanned using an Epson flatbed scanner and the area of toner which had been removed from the paper was determined by image analysis software such as the National Instruments IMAQ.

For the toners of Example II, the minimum fixing temperature was found to be from about 156° C., and the hot-offset temperature was found to be about equal to or greater than about 210° C., and the fusing latitude was about equal to or greater than about 43° C.

For the toner of Example III, the minimum fixing temperature was found to be from about 143° C., and the hot-offset temperature was found to be about equal to or greater than about 180° C., and the fusing latitude was about equal to or greater than about 37° C.

It will be appreciated that various of the above-disclosed and other features and functions, or alternatives thereof, may be desirably combined into many other different systems or applications. Also, it will be appreciated that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An emulsion aggregation toner composition having toner particles comprising a binder resin and an optional colorant, wherein the binder resin is a polyester-wax resin comprising a wax chemically incorporated by covalent bonding into a main chain of a polyester and including an acidic end group.

2. The toner composition according to claim 1, wherein the toner particles further include a crystalline polyester.

3. The toner composition according to claim 1, wherein the polyester-wax resin includes two acidic end groups.

4. The toner composition according to claim 1, wherein the binder resin is from about 50 weight percent to about 95 weight percent of the total weight of the toner particles.

5. The toner composition according to claim 1, wherein the polyester is an unsaturated polyester resin.

6. The toner composition according to claim 1, wherein the toner composition further comprises a photoinitiator.

7. The toner composition according to claim 1, wherein the polyester is poly(1,2-propylene-diethylene)terephthalte, polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-sebacate, polypropylene-sebacate, polybutylene-sebacate, polyethylene-adipate, polypropylene-adipate, polybutylene-adipate, polypentylene-adipate, polyhexalene-adipate polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate, polyethylene-pimelate, polypropylene-pimelate, polybutylene-pimelate, polypentylene-pimelate, polyhexalene-pimelate, polyheptadene-pimelate, poly(propoxylated bisphenol co-fumarate), poly (ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly (ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), poly(1,2-propylene itaconate), or mixtures thereof.

8. The toner composition according to claim 1, wherein the wax chemically incorporated into the main chain of the polyester is a polypropylene, a polyethylene or a polypropylene-ethylene wax.

9. The toner composition according to claim 8, wherein the wax includes one or two functional groups.

10. The toner composition according to claim 9, wherein the one or two functional groups are one or two hydroxyl end groups, one or two acidic end groups, or one hydroxyl end group and one acidic end group.

11. The toner composition according to claim 1, wherein the wax has no more than two functional groups.

12. The toner composition according to claim 1, wherein the polyester-wax resin has an acid number of from about 5 mg/eq. KOH to about 40 mg/eq. KOH.

13. The toner composition according to claim 1, wherein the polyester-wax resin has an acid number of from about 13 mg/eq. KOH to about 22 mg/eq. KOH.

14. An electrophotographic image forming apparatus comprising a photoreceptor, a development system including an oil-less fixing member, and a housing in association with the development system for a developer comprising an emulsion aggregation toner comprising a binder and an optional colorant, wherein the binder is a polyester-wax resin comprising a wax chemically incorporated by covalent bonding into a main chain of a polyester and including an acidic end group.

15. A method for making toner particles comprising:

forming a polyester-wax resin emulsion comprising a polyester-wax resin comprising a wax chemically incorporated by covalent bonding into a main chain of a polyester and including an acidic end group, forming the polyester-wax resin emulsion and optional colorant into a pre-toner mixture, and aggregating and coalescing the pre-toner mixture to form the toner particles.

16. The method according to claim 15, further comprising forming the polyester-wax resin by reacting a diol monomer, a diacid monomer and a wax prior to forming the polyester-wax resin emulsion.

17. The method according to claim 16, wherein there is excess diacid monomer such that the acid number of the polyester-wax resin is from about 5 mg/eq. KOH to about 40 mg/eq. KOH.

18. The method according to claim 15, further comprising forming a crystalline resin emulsion comprising a crystalline polyester resin, and combining the crystalline resin with the polyester-wax resin emulsion and optional colorant to form the pre-toner mixture.

19. The method according to claim 15, wherein forming the polyester-wax resin emulsion comprises dissolving the polyester-wax resin in a solvent to form a solution, and adding hot water to the solution, thereby resulting in evaporation of the solvent to form the polyester-wax resin emulsion.

* * * * *